US006200430B1

(12) United States Patent
Robert

(10) Patent No.: US 6,200,430 B1
(45) Date of Patent: Mar. 13, 2001

(54) ELECTRIC ARC GASIFIER METHOD AND EQUIPMENT

(76) Inventor: Edgar J. Robert, 632 Northhaven Cir., Glenshaw, PA (US) 15116

( * ) Notice: Subject to any disclaimer, the term of this patent is extended or adjusted under 35 U.S.C. 154(b) by 0 days.

(21) Appl. No.: 09/152,636

(22) Filed: Sep. 14, 1998

Related U.S. Application Data

(60) Provisional application No. 60/071,735, filed on Jan. 16, 1998.

(51) Int. Cl.[7] ..... C10J 3/46

(52) U.S. Cl. ..... 204/164; 48/103; 48/202; 204/165; 204/168; 204/172; 422/186.26; 422/186.04; 422/906

(58) Field of Search ..... 48/103, 202; 204/164, 204/165, 168, 171, 172, 212, 225; 422/186.26, 186.04, 906

(56) References Cited

U.S. PATENT DOCUMENTS

| | | | | |
|---|---|---|---|---|
| 3,607,157 | | 9/1971 | Schlinger et al. | 48/206 |
| 4,421,475 | | 12/1983 | Frick | 431/207 |
| 4,472,172 | * | 9/1984 | Sheer et al. | 48/202 |
| 4,606,799 | * | 8/1986 | Pirklbauer et al. | 204/170 |
| 4,690,743 | | 9/1987 | Ethington et al. | 204/168 |
| 4,801,435 | * | 1/1989 | Tylko | 422/186.04 |
| 4,889,699 | | 12/1989 | Najjar et al. | 423/210 |
| 5,685,971 | * | 11/1997 | Schroder et al. | 205/642 |

* cited by examiner

*Primary Examiner*—Shrive Beck
*Assistant Examiner*—Frederick Varcoe
(74) *Attorney, Agent, or Firm*—Law Offices of K. Patrick McKay

(57) ABSTRACT

A method, and its associated equipment, for producing synthetic gas by means of an electric arc-activated, non-catalytic burner which utilizes up to three streams of product inputs. A primary spray is heated by an electric arc formed between two electrodes. A second spray is then injected and mixed with the heated primary fluid. The resulting high-temperature, high pressure mixture is combined with a tertiary spray, an oxidant. The end product thereby produced is a synthetic gas, which becomes immediately available for combustion in furnaces, reactors, and other processes in the chemical, petroleum, and metals fabrication industries. The invention overcomes the deficiencies of existing processes. Those processes suffer generally from the same limitations, such as limited conversion efficiency, inability to operate at high pressures, requiring pure oxygen, in the case of combustion systems, or requiring a catalyst, a very expensive and perishable material that is subject to poisoning from trace elements in the fuel. The instant invention provides a more efficient synthetic gas production process having a low capital investment, one which is not dependent on oxygen or a catalyst, and that uses low cost consumables.

5 Claims, 4 Drawing Sheets

ELECTRIC ARC GASIFIER METHOD AND EQUIPMENT

Specific Reference: The inventor claims as a specific reference and in reliance on the priority date so established, Provisional Application Electric Arc Gasifier No. 60/071,735, Application Filing Date Jan. 16, 1998.

BACKGROUND OF THE INVENTION

Field of the Invention

The present invention is a method, and its associated equipment, for producing synthetic gas by means of an electric arc-activated, non-catalytic burner, which utilizes up to three streams of product inputs. It is distinguished from current technologies in that it is not dependent on oxygen or the use of a catalyst. The primary fluid is ignited by an electric arc that produces the high-energy environment need for the process. The secondary fluid is mixed in the resulting plasma in a high temperature and high pressure process, producing the resulting gas, which becomes immediately available for combustion in furnaces, reactors, and other processes in the chemical, petroleum, and metals fabrication industries. It may also be mixed with a tertiary gas for reforming or for a partial oxidation process.

Description of the Related Art

Synthetic gas is a product widely used in the chemical and steel industry as an intermediate raw material for the production of chemical products or other raw materials. An example is a Direct Reduced Iron in the case of the steel industry. There are many types of processes currently utilized, and the art is well-developed in industry. The majority of processes utilize pure oxygen as the combustion agent. Combustion occurs in the range of temperatures of 1000° to 1350° C. Standard gasifiers, which are sometimes referred to as gas reformers in the steel industry, are based on a low temperature process which uses a catalyst. In general, the operating temperature of these gasifiers is below 700° C.

The partial oxidation process is a well-known process for converting liquid hydrocarbonaceous and solid carbonaceous fuels into synthesis gas, reducing gas, and fuel gas. The partial oxidation of liquid hydrocarbonaceous fuels such as petroleum products, and slurries of solid carbonaceous fuels such as coal and petroleum coke, are well known processes. These operate at temperatures up to 1100° C., and rely on the use of oxygen because of the energy balance. The only source of energy to these gasifiers results from combustion of methane or carbon. In order to maintain an adequate temperature, they have to operate with oxygen. They can not operate with air.

The Texas Partial Oxidation Gasification Process is an established processing means for solid carbonaceous fuels including petroleum coke and coal, as well as for ash-containing heavy liquid hydrocarbonaceous fuel. For example, water slurries of petroleum coke are reacted by partial oxidation, as described by U.S. Pat. No. 3,607,157.

Described in U.S. Pat. No. 4,889,699 is a process for the production of gaseous mixtures comprising $H_2$+CO by the partial oxidation of a feedstock comprising a heavy liquid hydrocarbonaceous fuel having a nickel and vanadium-containing ash, or petroleum coke having a nickel and vanadium-containing ash, or mixtures thereof. The feedstock includes a minimum of 0.1 wt. % of sulfur and greater than about 7 ppm, such as about 10 parts per million (ppm) to about 70,000 ppm of silicon.

In U.S. Pat. No. 4,421,475, a gasification burner having an electrically heatable gasification chamber is described. The temperature of this gasification chamber is measured by a temperature sensor and kept at an optimal value by means of a control device, to prevent fuel carbonization.

Prototypical of the current technologies, but one which uses a diffuse electrical plasma, is that described by Ethington, et al., in U.S. Pat. No. 4,690,743. The system described therein demonstrates the ignition of oil at the interface of a mixture of oil and water, in a closed tank. A voltage step-up transformer connects a potential of about 2–5 kV across an arc gap between the electrode and the water-oil interface. Electrical breakdown of the oil, due to the high voltage, produces an initial arc across the gap, which, at steady state, becomes a diffuse, partially-ionized, stable plasma. A chamber is positioned above and around the plasma to collect the gases which escape from the ionized reaction zone.

These existing processes suffer from generally the same limitations. Most have limited conversion efficiency, cannot operate at high pressures, require pure oxygen, in the case of combustion systems, or require a catalyst, a very expensive and perishable material that is subject to poisoning from trace elements in the field. All the commercial systems currently in the market require a substantial capital investment.

In the present invention, the additional energy in replacement of combustion is provided by the electric arc, which allows for operation with air or mixture of gases. The use of the electric arc makes this process more independent of the gases used for the reaction. Unique to this invention is the high efficiency addition of energy to the process, by electricity, which makes this gasifier more flexible and more economical. The existing art relies on chemical reaction to provide energy input, thereby adding appreciably to the cost of those systems.

The present invention overcomes all of the noted deficiencies in a unique, but easily implemented fashion. All of the materials relied upon and currently employed in the various industries, and are, therefore, readily available. The main difference then, from an equipment application perspective, is that the present invention does not use a catalyst or a burner to produce the reaction, and can operate at very high pressures.

As compared with the Ethington system, described above, the present invention is dramatically more efficient because of the higher operating temperature and the positioning means employed to direct the electric arc. Also, the current invention can process a wide range of carbon/hydrogen materials and is not dependent on oxygen.

Another important advantage of the system as described and claimed herein is the ability of the system to control the ratio of Carbon Monoxide to Hydrogen in the combustion process. No other system can allow for the control that is accommodated in the process of the current invention.

This capacity of the system is based on the ability to regulate electric energy as required to obtain the thermal balance. Other systems are based on chemical reactions and, since the formation of Hydrogen is endothermic and the formation of CO is slightly exothermic, the ratio of Carbon Monoxide to Hydrogen is very restricted.

The balance of the system Carbon Monoxide to Hydrogen ratio is allowed by selecting the oxidant between steam, oxygen, and CO2, and regulating the energy required to satisfy the chemical reactions via electric power.

PRIOR ART

U.S. Pat. No. 4,421,475 teaches a gasification burner having an electrically heatable gasification chamber.

U.S. Pat. No. 4,690,743 shows a system, which ignites oil at the interface of a mixture of oil and water in a closed tank. A voltage step up transformer connects a potential of about 2–5 kV across an arc gap between the electrode and the water-oil interface. The evolving gas is collected above the ignition point.

U.S. Pat. No. 3,607,157 demonstrates the partial oxidation of water slurries of petroleum coke.

SUMMARY OF THE INVENTION

The Primary objective of the instant invention is to provide a synthetic gas production process requiring a low initial capital investment.

A secondary objective is to provide a process that does not require a catalyst, an expensive element of current processes. In addition, this invention is not sensitive to trace elements such as Sulfur, which usually poison the catalyst in other, current processes.

A third objective is to provide a process having a high conversion rate and operating at pressures of 750 psi and higher, if required by the application. Both attributes increase the efficiency of the present invention over current processes.

A fourth objective is to employ a process that requires no pure oxygen. The instant invention can operate with air, steam or $CO_2$, depending on the application and the economies required of the process downstream.

A fifth objective is to utilize a process with a low operating cost; the consumables which can be used in the invention herein are readily available, at very low cost.

A sixth objective is to minimize the production of $CO_2$, which is an advantage because it does not require $CO_2$ removal systems downstream from the gasifier.

A final objective of the process disclosed and claimed herein is its versatility to a wide variety of applications. It can be used for the production of synthetic gas from other gases (e.g., methane), from powder coal, or from slurries of combustible materials. As the existing art principally relies on the use of natural gas or coal powders, this objective contributes significantly to the flexibility of the present invention as a gasifier.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated device, and such further applications of the principles of the invention illustrated herein, as would normally occur to persons skilled in the art to which the invention relates.

Method

Figure 1:
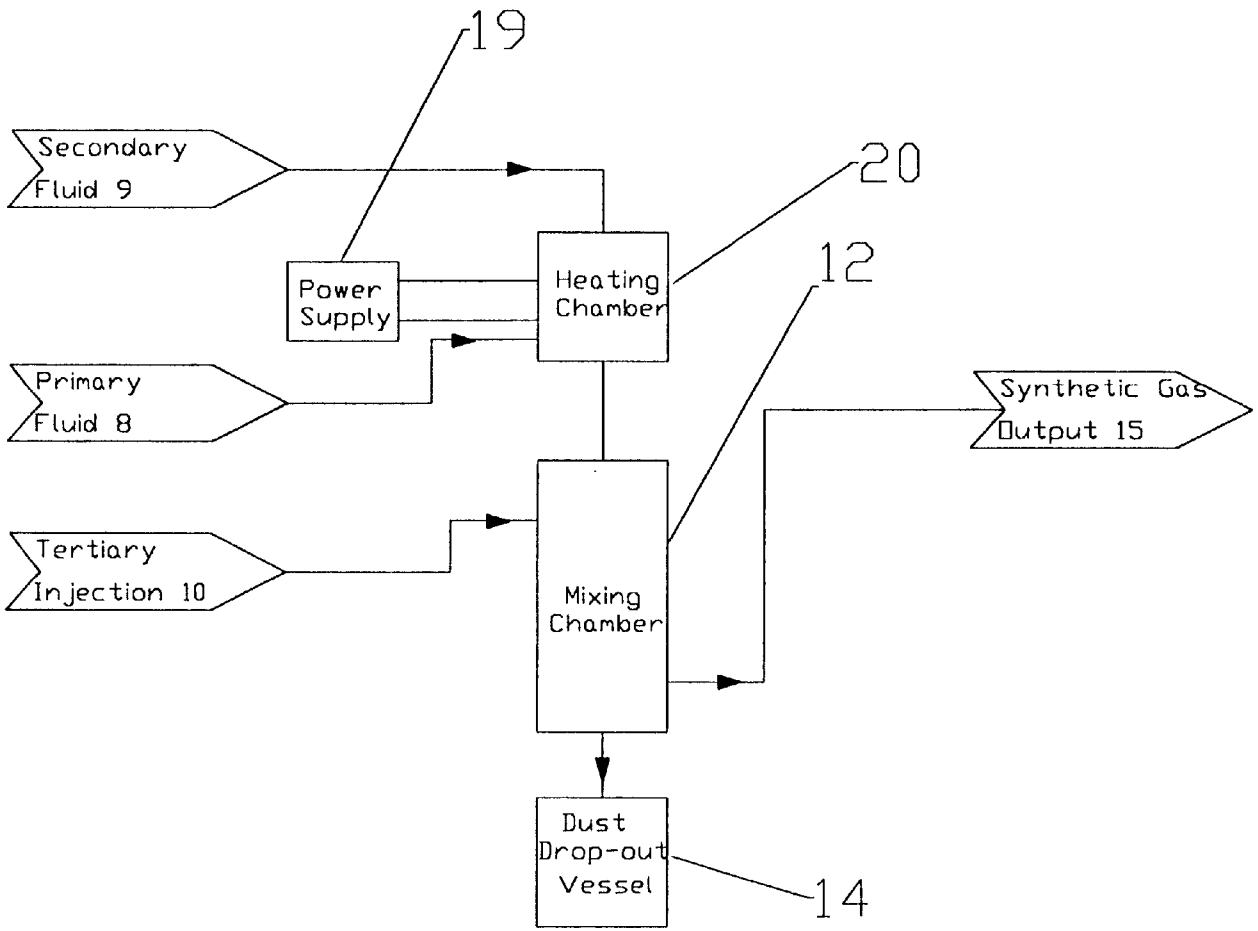
FIG. 1 is a Process Flow Diagram of the method of an Electric Arc Gasifier showing the stages of product stream ignition, expansion, mixing and output.

The method of the instant invention is shown in FIG. 1, a Process Flow Diagram. The process entails the injection of a primary fluid 8, that is heated by an electric arc formed between two electrodes, thereby producing a plasma. The position and thermal behavior of this plasma is defined by the flow rate of the primary fluid 8. An AC or DC Power Supply 19 provides the necessary power for the electric arc.

A Secondary Fluid 9 is also injected through a hollow electrode, if required by the process. In the application of synthetic gas production, this secondary fluid may be methane. Other suitable, combustible fluids are supported by this system, also, such as coal powder or liquid slurries of coal and water. The purpose in this particular application, as described herein, is providing the necessary carbon, and some of the hydrogen, the system to produce synthetic gas.

The Primary Fluid 8 will develop an extremely high temperature in the electric arc, in the range of 5500° C. or higher. At such high temperature, the fluid will crack into the elemental components. The Secondary Fluid 9 will mix with the heated primary fluid 8, increasing its temperature. The temperature of the mix will depend on the ratio of the flow rates of both fluids and the physical and chemical properties of the fluids. The system will be designed to obtain a resulting temperature of the two mixed fluids between 1500° and 4000° C. This operating temperature will be governed by the properties of the material used as electrodes, and the objective of the process.

The mixed fluids will crack into its elemental components. Given the high temperature at which these fluids will be exposed, the dissociation of the compounds will occur at a very high reaction rate. For the embodiment where the Primary Fluid 8 is methane, the product of this reaction will be carbon dust, and hydrogen gas.

This method will operate the heating and mixing chambers at pressures ranging from barometric to several thousand of psi, limited mainly by the pressure vessel required to contain the components. When the pressure is increased, the conductivity of the gas in the electric arc will increase, and the length of the arc will increase, accordingly. The internal design of the electrodes allows for an automatic correction of the position based on the electrical response of the electric arc.

The reaction in the Heating Chamber 20, as a gasifier, consists in general of the cracking of a hydrocarbon and is endothermic. It can be generally characterized:

$$CH_4 + Heat \rightarrow C + 2H_2 \quad [1]$$

The gas processed in the Heating Chamber 20, as described above, will be passed through a Mixing Chamber 12, into which is injected a Tertiary Injection 10. The Tertiary Injection 10 is an oxidant injected to react the carbon dust to carbon monoxide (CO). The ratio between the oxidant and carbon will be set to combust as much carbon as possible, but without significant formation of $CO_2$. In the particular case of a gasifier for the production of high quality synthetic gas, the oxidant could be oxygen, steam, or $CO_2$. Injecting steam or mixtures of steam and oxygen can modify the ratio of CO to hydrogen, an advantage of this invention.

In the case of production of CO and hydrogen, the Mixing Chamber 12 will operate between 1500 and 1700° C. At this temperature range it is expected to have a conversion from $CH_4$ to CO and $H_2$ of better than 99.9% at 30 bar pressure.

The reaction of the Tertiary Injection 10 is that of an oxidant and it is necessary to obtain the reforming reaction. In the Mixing Chamber 12 the process is exothermic and, when injecting $CH_4$ as either the secondary or primary fluid, can be generally characterized by the following reaction:

$$C+\tfrac{1}{2}O_2 \rightarrow CO \qquad [2]$$

The reaction is favored by high temperature and is a primary characteristic of the present invention. The operating pressure varies from barometric to about 750 psi and within that range it is possible to obtain very good conversion rates in the reaction of equation [2] above.

The synthetic gas produced is then removed from the Mixing Chamber 12 through a Synthetic Gas Output Port 15.

Any excess of dust, or solids in suspension in the off-gas stream, will be removed through a Dust Drop-out Vessel 14.

Equipment

Figure 2:
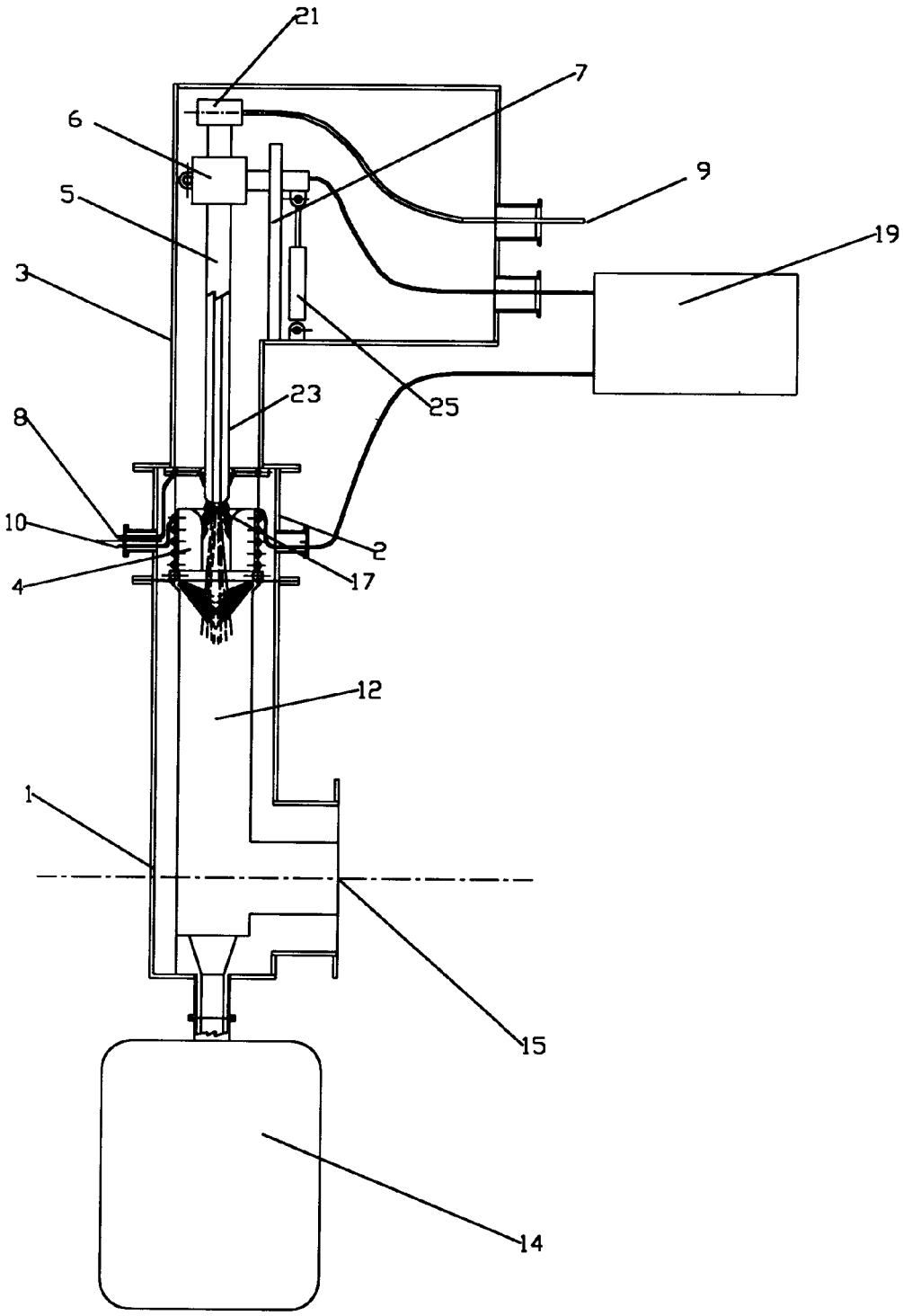
FIG. 2 is a side view of the Electric Arc Gasifier system equipment showing the constituent parts, particularly the four major subassemblies: Containment Shell Lower Body, the Containment Shell Intermediate Body, with Mixing Chamber, the Containment Shell Upper Body with Electrode Positioning System, and the Power Supply.

A typical equipment configuration for the employment of the instant method is shown in FIG. 2. It consists of a Containment Shell Lower Body 1, Containment Shell Intermediate Body 2, and Containment Shell Upper Body 3 that provides the pressure boundary for the system. Inside the Containment Shell Intermediate Body 2, which also forms a pressure containment boundary, is a Fixed Electrode 4, and a Mobile Hollow Electrode 5, both made from graphite or similar material. The Electrode Guiding System 7 and the Electrode Positioning System 21 control the position and alignment of the Mobile Hollow Electrode 5. The Mobile Hollow Electrode 5 is secured by an Electrode Clamp 6. Electric wires connect the Mobile Hollow Electrode 5 and the Fixed Electrode 4, to the Power Supply 19. The Power Supply 19, may be AC or DC. The objective of this Power Supply 19 is to create an Electric Arc 17 between both electrodes, and, together with the Electrode Positioning System 21, to provide stability to the arc in various operating conditions.

Several fluids may be injected in the system to produce the desired results. The Primary Fluid 8, feeds a Primary Fluid Annular Distributor 16 (FIG. 4) which creates the Primary Gas Spray 16*a*. The fluid may be a hydrocarbon, nitrogen, argon or any other fluid that may be selected based on the objective of the application. The objective of this fluid is to create a swirl effect at the tip of the Mobile Hollow Electrode 5 that will impose a rotating movement on the Electric Arc 17. A further objective of the Primary Fluid 8 is to flow the fluid through the Electric Arc 17, and increase its temperature, creating a flame of plasma that will flow through the interior of the Fixed Electrode 4. A further objective of this Primary Fluid 8 is to push the Electric Arc 17 into the Fixed Electrode 4, to increase the contact between the Electric Arc 17 and the Secondary Spray 18.

The Mixing Chamber 12 provides enough residence time to assure a complete mixing and reaction of the substances, thereby insuring a complete chemical reaction. Typically, this chamber is sized to provide at least 0.2 seconds of residence time. The temperature developed in this chamber varies with the process. In the particular case of a gasifier, the temperature will be held at 1500° C. or above. The refractory wall of the Mixing Chamber 12 is designed to maintain the temperature of the shell below 340° C., and the working lining is selected to withstand the process temperature selected.

The temperature of the plasma generated in the Electric Arc 17 is at least 5500° C. The Secondary Fluid 9 and the Tertiary Injection 10 complete the material and energy balance of the system to provide the desired temperature in the Mixing Chamber 12. The energy balance will take into account the energy input provided by the Electric Arc 17, the chemical reactions experienced in the Fixed Electrode 4 and in the Mixing Chamber 12, and the heat and power losses of the system.

The synthetic gas along with other products of the reaction will leave the system through the Synthetic Gas Output Port 15. Solid particle material that may be produced by the chemical reaction, such as carbon particles, will be dropped out at the bottom of the reactor in the Dust Drop-Out Vessel 14. The accumulation therein, if any, will be removed from time to time. In the particular case of production of Synthetic Gas, the chemistry of the off-gas through the synthetic gas output port 15 will be mainly CO gas, $H_2$ gas and, $N_2$ gas, if air is used as an oxidizing agent.

Figure 3:
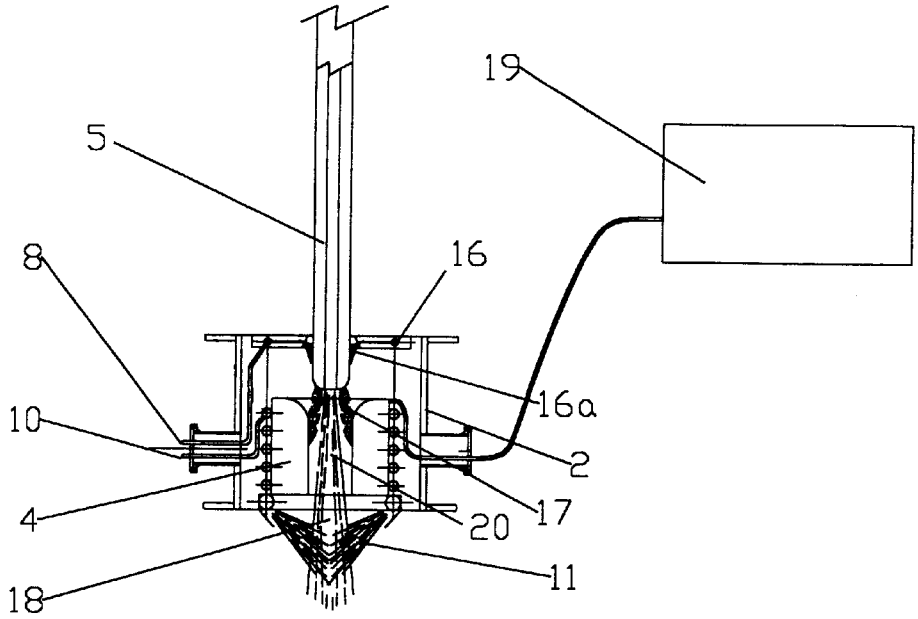
FIG. 3 is a detailed view of the Electric Arc Gasifier system Containment Shell Intermediate Body, particularly the electrode and electric arc components.

Secondary Fluid 9 allows the injection of a fluid through the center of the Mobile Hollow Electrode 5. With reference now to FIG. 3, the fluid flows through the Mobile Hollow Electrode 5 into the Heating Chamber 20. The Secondary Fluid 9 may be a gas, liquid or powder. The nature of the fluid may depend on the objective of the application. Typically, as in the case of a gasifier, the fluid may be methane gas.

A Tertiary Injection 10 may be used to cool the Fixed Electrode 4, and convey fluids to the Mixing Chamber 12, through a Tertiary Spray 11. The objective of the Tertiary Injection 10 is to react with the high temperature gas exiting the Fixed Electrode 4. Typically, in a Gasifier this Tertiary Injection 10 will be an oxidizing gas such as steam, $CO_2$, $O_2$, or air, depending on the particular conditions of the application.

Figure 4:
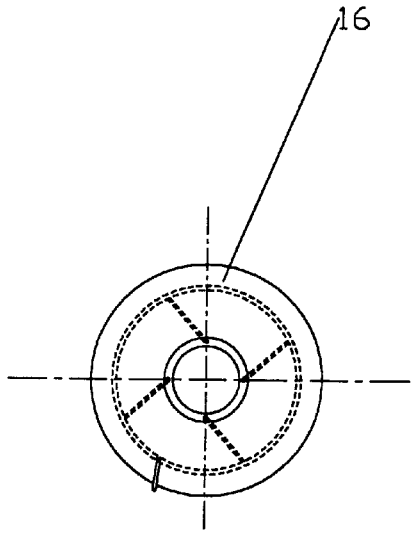
FIG. 4 is a top view of the Electric Arc Gasifier system equipment showing the Primary Fluid Annular Distributor.

FIG. 4 shows the Primary Fluid Annular Distributor 16 which evenly distributes the flow of the fluids for mixing within the assembly of FIG. 3.

Figure 5:
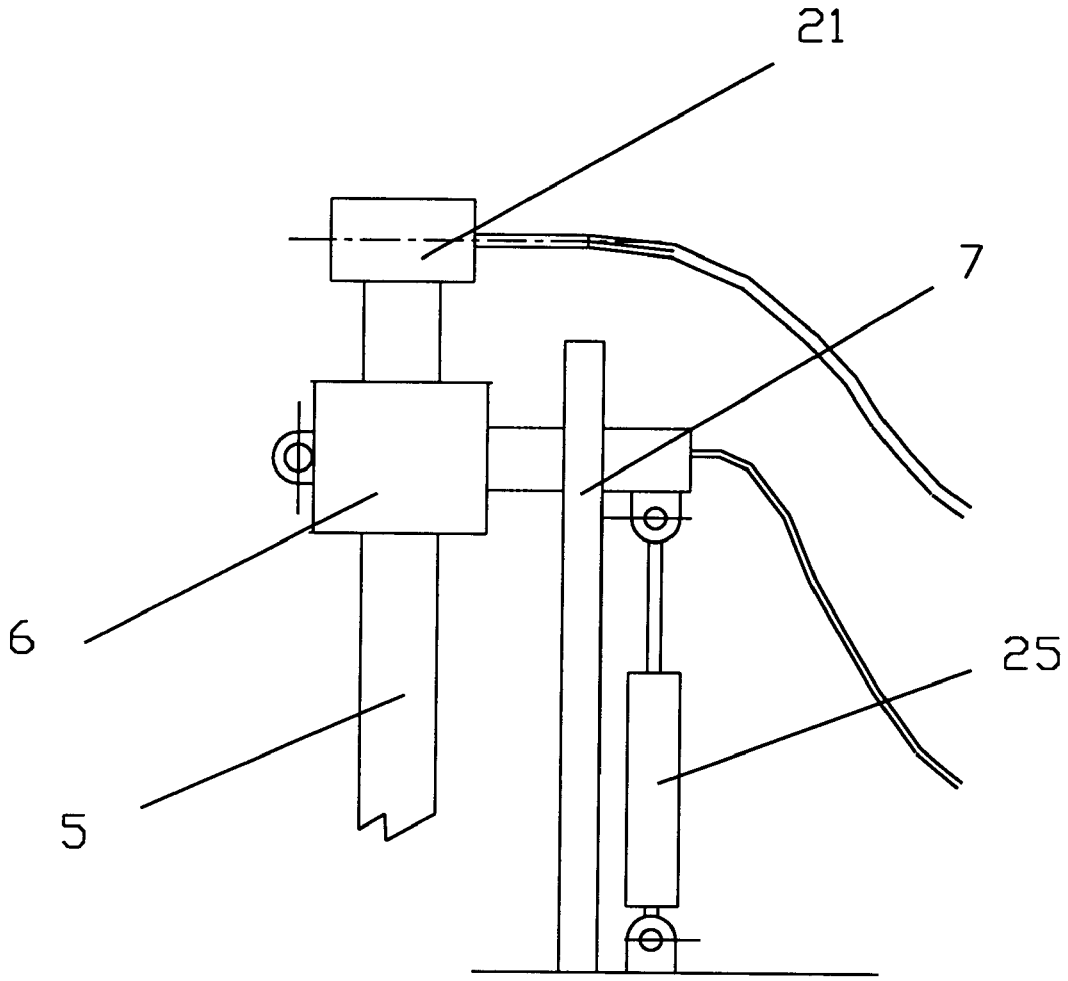
FIG. 5 is a view of the Guiding System and Positioning System from the side view demonstrating an embodiment of the means for positioning the electrode accommodating the Mobile Hollow Electrode.

FIG. 5 shows the electrode guiding system 7, which has the objective of adjusting the distance between the Mobile Hollow 5 Electrode and the Fixed Electrode 4 to meet the conditions required by the electric system. Depending on the operating conditions or the wear of the electrode, the length of the Electric Arc 17 may require a correction. The electrode guiding system 7 moves the Mobile Hollow Electrode 5 vertically to the correct position, in response to these changes. The electrode guiding system 7 consists of a carriage that is attached to the Electrode Clamp 6, and moves vertically guided by two vertical guides 23. The carriage rolls on the guides supported by four guide rails. The position of the carriage is set by a hydraulic cylinder 25, which is controlled by the electrical system through a standard hydraulic control system.

In instances where a correction is needed, as sensed by the system controls, the electric system will send the instruction to the hydraulic control system, which will actuate the hydraulic control system, extending or retracting the rod, and repositioning the carriage/clamp/mobile electrode subassembly.

The variables accounted for in the adjustment include voltage, power level, and current. The electrode position will be corrected to satisfy the set of electrical conditions, accounting for electrode wear, chemistry of the gas, gas flow rate, and pressure of the reactor. The adjustments made optimize the process variables for the set conditions.

The Power Supply 19 relied upon in the preferred embodiment system can be any alternating current device.

The voltage and power level of these units are fixed and the current delivered is set by the distance between electrodes. Since there is no reliance on direct current power supplies, the capital cost of the present invention is lower than that experienced by employing the existing art.

The electrodes used in the process consist of standard materials of construction such as graphite, alumina-graphite, composite graphite, tungsten, molybdenum, and, generally, any other refractory or metal. The preferred choice is graphite because of the low cost and high sublimation point.

The electrodes, both fixed and mobile, are consumable in the process and this is unique to the invention as disclosed herein because the standard solution of plasma based devices is non-consumable, water-cooled electrodes.

Since the electrodes are not water-cooled as is the standard in the art, the power efficiency of this system is higher than conventional plasma arc technology, which rely on the use of water-cooling jackets. This cooling wastes about 47% of the energy delivered to the electric arc.

The shell components are carbon steel with internal refractory lining. Internal components are constructed of typical carbon steel.

I claim:

1. A process for producing synthetic gas by means of an electric arc-activated, non-catalytic burner, comprising the steps of:

forming an electric arc between a mobile hollow electrode and a fixed electrode in a heating chamber, wherein both said mobile hollow electrode and said fixed electrode are consumable;

injecting a primary fluid through said electric arc, thereby forming a plasma, wherein said primary fluid is a material selected from the group consisting of argon, nitrogen, and methane;

allowing said primary fluid to create a swirl effect at a tip of said mobile hollow electrode, thereby imposing a rotating movement on said electric arc;

allowing a pressure within said heating chamber to increase, thereby changing a length of said electric arc;

allowing for an automatic correction of a position of said electric arc based on an electrical response of said electric arc after said pressure is increased;

mixing a secondary fluid into said plasma, thereby forming a gas mixture at high temperature which will crack into its elemental components, wherein said secondary fluid is a material selected from the group consisting of carbon powder, coal powder, powder with hydrogen-bearing materials, slurries containing carbon-bearing materials, slurries containing hydrogen-bearing materials, liquids containing carbon-bearing materials and liquids containing hydrogen-bearing materials, and wherein one of said elemental components is carbon in the form of dust when exposed to said plasma;

passing said gas mixture into a mixing chamber having a size which provides approximately 0.2 seconds of residence time;

injecting a tertiary gas into said mixing chamber at pressures up to 750 psi, thereby mixing said gas mixture with said tertiary gas, wherein said tertiary gas is an oxidant injected to react said dust into carbon monoxide and wherein said tertiary gas is a material selected from the group consisting of steam, $CO_2$, oxygen, and air, and thereby forming a synthetic gas;

removing said synthetic gas from said mixing chamber through an outlet port; and, removing excess dust or solids from said mixing chamber through a dust dropout vessel.

2. An apparatus for producing synthetic gas by means of an electric arc-activated, non-catalytic burner, comprising:

(a) a power supply;

(b) a pressure boundary having therein three subsystems, comprising:

(1) a containment shell upper body, comprising:

a. a long, hollow, vertically disposed mobile hollow electrode having an inlet end and an outlet end;

b. an electrode clamp rigidly connected to said mobile hollow electrode;

c. an electrode guiding system fastened to said electrode clamp and powered from said power supply, whereby said mobile hollow electrode can be incrementally maneuvered lengthwise within said containment shell upper body;

d. an electrode positioning system fastened to said electrode clamp and powered from said power supply, whereby said mobile hollow electrode can be incrementally maneuvered angularly within said containment shell upper body; and, e. a secondary injection port connected to said inlet end and having a source of secondary injection gas as a supply stream, whereby said secondary injection gas is fed into said inlet end;

(2) a containment shell intermediate body, comprising:

a. a heating chamber having a lower port, and having an upper port through which is disposed said outlet end, whereby said secondary injection gas is discharged into said heating chamber through said outlet end;

b. a cylindrically-shaped fixed electrode disposed circumferentially around said outlet end, thereby receiving said secondary injection gas;

c. a primary annular distributor disposed at said upper port around said outlet end and having a source of primary injection fluid as a supply stream, whereby said primary injection fluid is fed into said fixed electrode mixing with said secondary injection gas, forming a synthetic gas mixture; and, d. a tertiary gas annular distributor disposed about said fixed electrode, and having a source of tertiary gas as a supply stream whereby said tertiary gas is mixed with said synthetic gas mixture in said outlet end, and, (3) a containment shell lower body having an intake at said outlet end whereby said synthetic gas mixture is received and expanded therein, a synthetic gas outlet port and a dust drop out port.

3. An apparatus for producing synthetic gas by means of an electric arc-activated, non-catalytic burner as claimed in claim 2, further comprising an alternating current power supply.

4. An apparatus for producing synthetic gas by means of an electric arc-activated, non-catalytic burner as claimed in claim 2, further comprising a mobile hollow electrode made from a material selected from the list of graphite, alumina-graphite, composite graphite, tungsten, or molybdenum.

5. An apparatus for producing synthetic gas by means of an electric arc-activated, non-catalytic burner as claimed in claim 2, further comprising a fixed electrode made from a material selected from the list of graphite, alumina-graphite, composite graphite, tungsten, or molybdenum.

* * * * *